United States Patent [19]

Pattison

[11] 4,294,572

[45] Oct. 13, 1981

[54] INTERNAL FLUID COMMUNICATION SYSTEM FOR POWER CYLINDERS

[76] Inventor: Jack E. Pattison, 115 S. Ridgeway Dr., Battle Creek, Mich. 49015

[21] Appl. No.: 894,691

[22] Filed: Apr. 10, 1978

[51] Int. Cl.[3] ..... B66F 9/22

[52] U.S. Cl. ..... 414/641; 92/52; 92/110; 92/162 R; 187/9 E; 414/664

[58] Field of Search ..... 92/51, 52, 53, 108, 92/61, 110, 113, 162 R; 414/641, 642, 663, 664, 665, 666, 667; 187/9 E

[56] References Cited

U.S. PATENT DOCUMENTS

| | | | |
|---|---|---|---|
| 1,221,469 | 4/1917 | Meyer | 92/113 |
| 3,134,231 | 5/1964 | McCreery | 92/162 R |
| 3,172,339 | 3/1965 | Quayle | 92/162 R |
| 3,207,044 | 9/1965 | Hall | 92/110 |
| 3,381,834 | 5/1968 | Gibson | 414/641 |
| 3,483,798 | 12/1969 | Parrett | 92/110 |
| 3,592,108 | 7/1971 | Rosaen | 92/52 |
| 3,664,636 | 5/1972 | Sherrill | 92/53 |
| 3,831,493 | 8/1974 | Wanger | 92/61 |
| 3,858,396 | 1/1975 | Bourges | 91/530 |
| 3,908,988 | 9/1975 | Avon | 92/52 |
| 3,920,084 | 11/1975 | Russell, Jr. | 92/52 |
| 4,080,870 | 3/1978 | Lusby | 92/111 |
| 4,093,092 | 6/1978 | Habiger | 414/642 |

*Primary Examiner*—Abraham Hershkovitz
*Attorney, Agent, or Firm*—Marmaduke A. Hobbs

[57] ABSTRACT

An internal fluid communication system in combination with a fluid operated power cylinder, such as that used on industrial lift trucks, in which a pair of tubular sections in telescopic relationship is disposed lengthwise within the power cylinder, forming a fluid passageway through the cylinder for transmitting fluid from one end of the cylinder to the other. The cylinder may be of either the ram or the cylinder and piston type. Two or more tubular sections may surround the first tubular section and form a plurality of parallel fluid passages passing through the power cylinder from one end to the other without communicating with the operating fluid in the cylinder. In the embodiment of the invention applicable to a cylinder and piston type hydraulic motor, one tubular section is disposed in the piston rod and the other tubular section passes through the piston and is in telescopic relationship with the tubular section in the piston rod. While the present internal fluid communication system is particularly adapted for industrial lift trucks, it may be used in a variety of different types of applications on different types of equipment and machinery.

6 Claims, 7 Drawing Figures

INTERNAL FLUID COMMUNICATION SYSTEM FOR POWER CYLINDERS

Internal Fluid Communication System for Power Cylinders

In many types of industrial equipment and machinery, several hydraulic systems are assembled and operated in a series relationship from a common or central source of fluid. In conventional installations of this type, separate fluid supply lines are provided for each system from the source, and these lines often are disposed in a parallel relation with the cylinder or cylinders of one or more of the other systems. Since one fluid system may be movable relative to another fluid system in the installation, the separate lines for the various systems have been of flexible construction, such as rubber hose, to permit relative movement between the systems during operation of the various systems. While this operating relationship may be required in a number of different types of equipment, a typical example of such a condition is found in industrial lift trucks whereina load handling attachment is mounted on an extensible upright on the front of the truck. It is customary in lift trucks of this type to utilize two or more telescopic sections consisting of channel members mounted in spaced relation to one another, rigidly held with respect to one another by a plurality of cross members. The telescopic sections are operated to extend and contract the upright by either a single cylinder or a compound ram consisting essentially of several cylinders arranged in telescopic relationship to one another. A carriage is slidably mounted on the front of the upright and a load handling attachment is supported by the carriage, both the carriage and attachment normally being capable of traversing the full height of the upright.

The attachment frequently is so constructed and designed that it can move laterally and to various angular positions with respect to the upright, and these movements are usually performed by one or more single or double acting hydraulic cylinders mounted on the carriage. The hydraulic cylinders on the carriage must be connected to a source of pressurized fluid, such as a pump on the truck, by a conduit which will accommodate and respond to the movement of both the extensible upright and the movement of the attachment relative to the upright. The conventional conduits for performing this function have been a plurality of hose lines extending from the truck upwardly along the upright to the attachment and usually trained on one or more reels or pulleys. These hose lines often interfere with the movement of the equipment and load and seriously restrict the view of the operator in maeuvering the truck and operating the upright and attachment. Further, since the hose lines are exposed and in close proximity to moving parts of the upright and attachment, they are easily damaged, thus requiring frequent inspection, servicing, and sometimes replacement. It is therefore one of the principal objects of the present invention to provide a fluid communication system for use with hydraulic and pneumatic cylinders and other types of fluid operated cylinders and motors, in which one or more fluid lines of the system are located in the fluid operating cylinders and are protected from normal damage from the movement of the equipment and/or load thereon.

Another object of the invention is to provide a fluid communication system for connecting a source of pressure with a fluid motor, including single and double acting hydraulic cylinders, which is particularly suitable for use with industrial lift trucks, and which includes locating the fluid lines in one or more operating fluid cylinders where they will not interfere with operation of the equipment or with the view of the operator of the equipment on which the system is installed.

Still another object of the invention is to provide an internal fluid communication system in which one or more lines thereof are located in fluid operating systems where seepage or small leaks are inconsequential with respect to the effective and efficient operation of the system, and which can be so constructed and designed that several fluid flow paths are included in a single line assembly.

A further object is to provide a fluid supply system for use in conjunction with fluid operating cylinders, which is simple in construction and operation and can be readily adapted to a variety of different types of cylinders and rams, and which can be used as conduits for the operating fluid of a motor and/or for regulating fluid for controlling the operation of a motor. Additional objects and advantages of the present invention will become apparent from the following description and accompanying drawings.

The present invention involves the use of telescopic tubes disposed in hydraulic, pneumatic or steam cylinders, normally of the compound type, for transmitting fluid from one end of the cylinder to the other end through the cylinders. The tubes may consist of multiple telescopic tube sections forming two, three or more fluid conduits which connect a source of fluid under pressure to a fluid operated motor or other device, such as a single or double acting hydraulic cylinder for an attachment on a lift truck. For the purpose of illustrating one application of the present invention, the following description will be directed to the use of the invention on the upright of an industrial lift truck shown in the accompanying drawings wherein:

Figure 1:
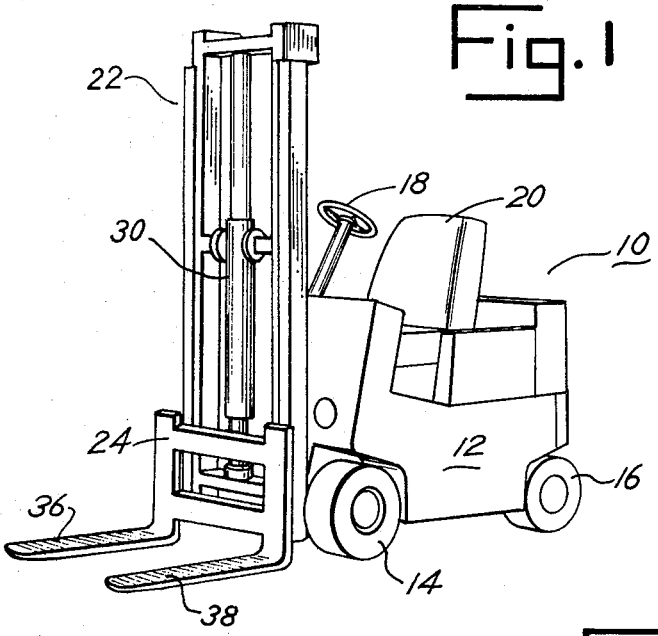
FIG. 1 is a perspective view of a lift truck in which the present invention is used, showing the upright in its lowered position.
Figure 3:
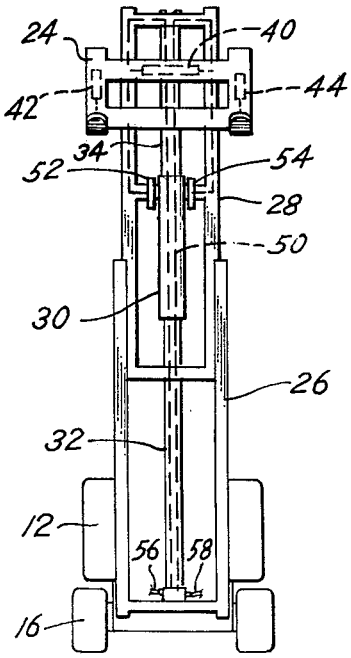
FIG. 3 is a front elevational view of the lift truck shown in FIGS. 1 and 2, with the upright and attachment in their elevated position.
Figure 2:
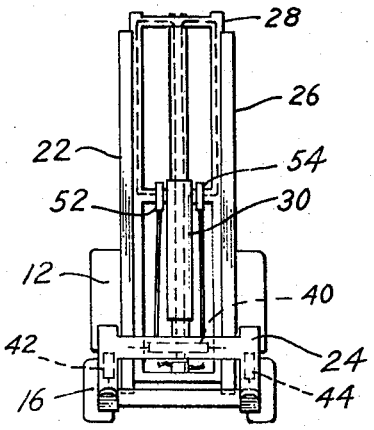
FIG. 2 is a front elevational view of the lift truck shown in FIG. 1.

Referring more specifically to the drawings and to FIGS. 1 through 3 in particular, numeral 10 indicates generally an industrial lift truck having a body 12, drive wheels 14 on the front and steerable wheels 16 on the rear, the latter wheels being controlled by a steering wheel 18 by a driver sitting in seat 20. An upright indicated generally by numeral 22 is mounted on the front of the truck and has an attachment 24 slidably mounted thereon. The upright shown in the drawing consists of two telescopic sections 26 and 28 operated between the lowered position shown in FIG. 2 and the raised position shown in FIG. 3, by a hydraulic ram 30 having a lower hydraulic section 32 and an upper section 34 telescopically disposed with respect to section 32. The ram is supplied by fluid from a pump or other suitable source on the truck body 12 through one or more conduits such as conduit 35, connected to the lower part of the ram. The attachment is shown as the fork type having two forwardly extending tines 36 and 38, and is included for the purpose of showing one type of attachment usable with the present system. The attachment has one or more cylinders 40, 42 and 44 for shifting the position of the attachment relative to the upright, the cylinders being supplied by fluid through the present system, illustrated schematically at numeral 50 in the ram, and by hose lines wound on reels 52 and 54 and connecting the system 50 with one or more of the cylinders 40, 42 or 44. For the purpose of the present description, the hose lines will be referred to as being connected to cylinder 40, which is used for shifting the attachment laterally in both directions relative to the upright. The fluid is supplied to system 50 through hose lines 56 and 58 or other flexible conduits disposed near the bottom of the hydraulic ram and connected to a source of fluid under pressure in the body 12 of the truck. The type of truck and the type of equipment on which the present system is used, have been included merely for the purpose of illustrating one use of the invention, the present concept being adapted for use on a variety of different equipment and machinery, wherein the problem of transmitting either operating or control fluids from a source and control center to remote cylinders or other motors is involved, the industrial truck of the type shown and described herein being a common example in which the problem solved by the present system is normally encountered.

Figure 4:
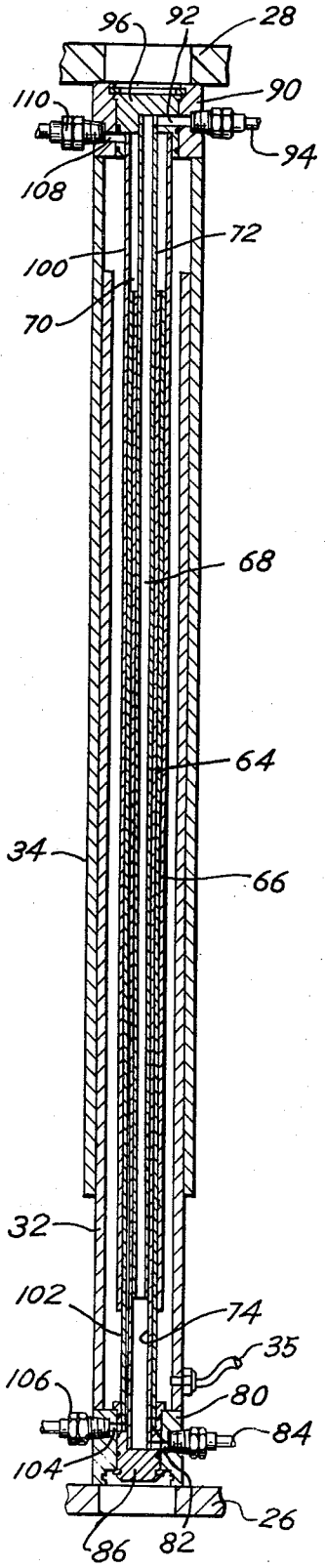
FIG. 4 is a vertical cross sectional fragmentary view of the ram for operating the upright shown in the preceding figures and illustrating the present invention.
Figure 5:
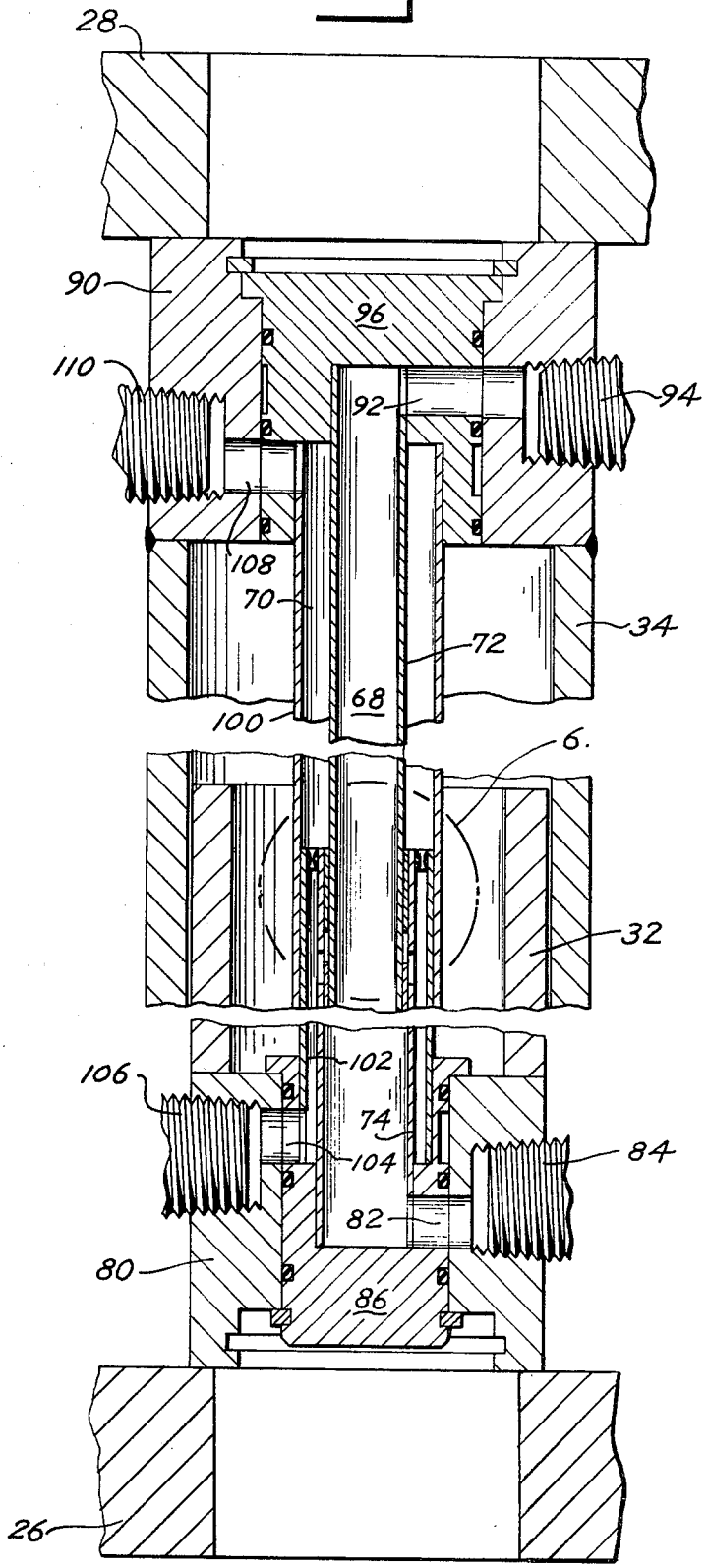
FIG. 5 is a fragmentary enlarged cross sectional view of the ram and the tubes and connectors forming the structure of the present invention illustrated in FIG. 4.

In FIG. 4, the hydraulic ram 30 is shown in combination with the present internal fluid communication system, consisting of an inner tube assembly 64 and an outer tube assembly 66, providing two fluid passages 68 and 70 connecting the source of fluid on the truck body with opposite ends of a double acting cylinder, for example. The inner tube assembly includes an upper tube section 72 and a lower tube section 74 telescopically assembled in tube 72. As the two ram sections move relative to one another, the two tubular sections 72 and 74 telescope relative to one another to maintain a closed passageway between the upper and lower ends of the passage. Passage 68 is connected to the source of fluid through end member 80 by passage 82 and conduit 84, the lower end of the tube section being sealed by a plug 86 mounted in a center bore of the end member. Passage 68 is connected to the hydraulic cylinder through upper end member 90 by passage 92 and conduit 94, the upper end of section 72 being sealed by plug 96 mounted in a center bore in end member 90. The two telescopic sections may be sealed by an O-ring or other suitable seal not shown.

Tube assembly 66, which is spaced from tube assembly 64, providing passage 70 for hydraulic fluid to one end of the double acting cylinder, consists of an upper section 100 and a lower section 102 telescopically received in section 100 for movement therein, the passage 70 being connected to the source of fluid in the body 12 by a passage 104 in end member 80 and by a conduit 106 connected thereto, and the upper end of the passage being connected to the hydraulic cylinder by passage 108 in member 90 and by a conduit 110 connected thereto. Thus, as the hydraulic ram sections move relative to one another, the sections of both tube assemblies 64 and 66 extend and contract to maintain sealed passageways 68 and 70. An O-ring or other suitable sealing means may be provided between sections 100 and 102; however, any seepage which may occur between the two sections is normally of no consequence, regardless of which direction the fluid may seep. While only two telescopic tube assemblies have been shown in the internal communication system just described, a third or a fourth tube assembly may be used to provide additional passageways between the source of fluid and cylinders or other fluid motors remote from the source, such as cylinders 42 and 44, the tube assemblies forming the additional passages being essentially the same as the two shown and described in detail herein.

Figure 6:
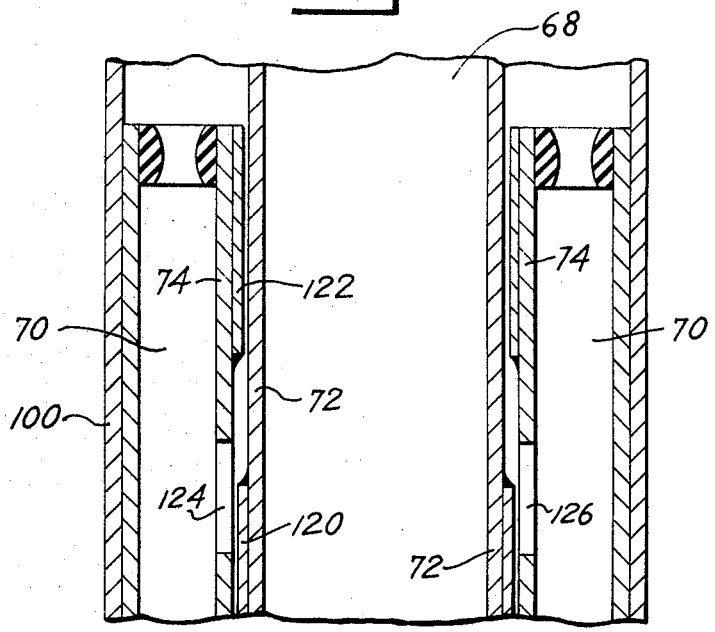
FIG. 6 is a fragmentary cross sectional view of the tubes forming the present fluid communication system illustrating further details thereof, the section being taken at the area indicated by numeral 6 on FIG. 5.

Sliding retainer rings 120 and 122, as best seen in FIG. 6, are secured to the external surface of tube section 72 and to the internal section of tube section 74, respectively. These sliding retainer rings are secured firmly to the respective tube sections and form a retainer to prevent the tubes from separating as they are extended during operation, such as could occur in a three section tube assembly. Holes 124 and 126 connect the tube with the space between the two sliding rings to permit the flow of oil into the area between the rings as the sections telescope relative to one another and to form a hydraulic cushioning action as the rings approach one another. The tube assemblies may be constructed of brass or other suitable metal tubing, or of suitable plastic tubing of substantially rigid construction capable of withstanding the limits of pressure in the tube assemblies and hydraulic cylinder.

In the operation of the ram and the internal fluid communication system described in detail herein, sections 72 and 74 of tube assembly 64 and sections 100 and 102 of tube assembly 66 move telescopically relative to one another as the two sections 32 and 34 of the hydraulic ram likewise move telescopically relative to one another as they operate upright 22, in response to hydraulic fluid from conduit 35. Thus, by the telescopic relationship of the tubes, passages 68 and 70 continually provide fluid for operating a double acting cylinder on the attachment. Since the tubes are mounted internally in the ram, they are not exposed to damage from bumping or other damage as the industrial truck and/or the load thereon are maneuvered during the operation of the truck. Further, the communication tube assemblies for operating the cylinders on the attachment are concealed and provide a more compact arrangement whereby the driver has greater visibility in maneuvering the truck to pick up a load and thereafter in maneuvering the truck with the load thereon, since the conventional hose lines, replaced by the present internal fluid communication system, are eliminated.

Figure 7:
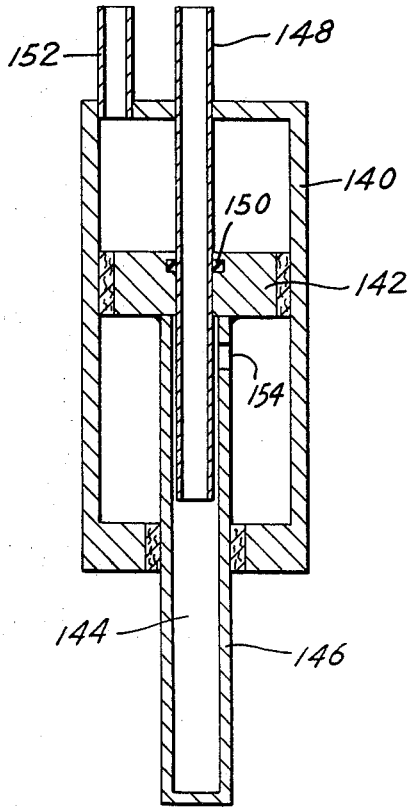
FIG. 7 is a fluid cylinder illustrating a modified form of the present invention.

The internal fluid communication system may be used in conjunction with a hydraulic system such as that described in detail herein, or with a pneumatic, steam or water system. It can also be effectively used in conjunction with cylinders or other types of hydraulic cylinders, such as cylinders with reciprocating piston and piston rod. A modification of the system is illustrated in FIG. 7, in which a cylinder 140 contains a reciprocating piston 142 and, as illustrated, a single hydraulic passage 144 contained in piston rod 146 is connected to the hydraulic motor by tube 148 and telescopically extends through piston 142 into the passage 144 of piston rod 146. An O-ring 150 is preferably used to seal the internal fluid system from the hydraulic fluid in cylinder 140. In the embodiment shown in FIG. 7, the fluid for operating the double acting cylinder is supplied through conduit 152 to one side of the piston 142 and through tube 148, passage 144 and port 154 to the opposite side of the piston; thus passage 148 is utilized for both the operating and control fluids. However, other operating arrangements for the cylinder may be used if desired.

While only two embodiments of the present internal fluid communication system have been described in detail herein, various other changes and modifications may be made without departing from the scope of the invention.

I claim:

1. In a lift truck having an upright with two sections, each with spaced vertical side members, and a fluid operated attachment on said upright: a fluid operated ram disposed vertically between said side members and in spaced relation thereto and consisting of two ram sections with directly interconnecting chambers containing the operating fluid therefor, for operating said upright sections between raised and lowered positions, a conduit having a first pair of tubular sections comprising upper and lower tubular sections disposed in telescopic relationship lengthwise within the chambers containing the operating fluid of said ram and forming a first fluid passageway for transmitting fluid through said ram separate from the operating fluid therein, a bottom end member connecting the lower end of said lower tubular section with the lower end of said lower ram section, means forming a passage in said bottom end member for receiving fluid from a source to be transmitted through the first passageway in said telescopic sections, a top end member connecting the upper end of said upper tubular section with the upper end of said upper ram section, and means forming a passage in said top end member for transmitting the fluid in said first passageway to said attachment.

2. A fluid operated ram as defined in claim 1 in which a second pair of tubular sections is disposed around said first pair of tubular sections and is spaced therefrom to form a second fluid passageway parallel to said first fluid passageway, a means forming a second passage in said bottom end member, a means connecting said second passage to a source of fluid, a means forming a second passage in said top end member, and means for transmitting fluid in said second passageway through said second passage in said top end member and to said attachment.

3. A fluid operated ram as defined in claim 1 in which a sliding seal is provided between the telescopic tubular sections to minimize the flow of fluid between said fluid passageway and the operating fluid in said ram.

4. A fluid operated ram as defined in claim 2 in which a sliding seal is provided between the telescopic tubular sections of the first and second pair of sections to minimize the flow of fluid between said fluid passageways and the operating fluid in said ram.

5. In a lift truck having a body and an upright on said body: the combination of a vertically positioned hydraulic cylinder having upper and lower relatively movable parts having the operating fluid chamber in one part directly interconnected with the operating fluid chamber of the other part for operating said upright, a hydraulically operated attachment on said upright, a conduit having a first pair of tubular sections comprising upper and lower tubular sections disposed in telescopic relationship lengthwise within the operating fluid chambers and forming a first fluid passageway for transmitting fluid through said cylinder separate from the operating fluid therein, a bottom end member connecting the lower end of the lower tubular section with the lower part of said cylinder, means forming a passage in said bottom end member for receiving fluid from a source to be transmitted through the first passageway in said telescopic sections, a top end member connecting the upper end of the upper tubular section with the upper part of said cylinder, and means forming a passage in said upper end member for transmitting the fluid in said first passageway to said attachment.

6. A fluid operated ram as defined in claim 5 in which a second pair of tubular sections is disposed around said first pair of tubular sections and is spaced therefrom to form a second fluid passageway parallel to said first fluid passageway, a means forming a second passage in said bottom end member, a means connecting said second passage to a source of fluid, a means forming a second passage in said top end member, and means for transmitting fluid in said second passageway through said second passage in said top end member and to said attachment.

* * * * *